US005284495A

United States Patent [19]

Baillargeon et al.

[11] Patent Number: 5,284,495

[45] Date of Patent: Feb. 8, 1994

[54] OLIGOMERIC/POLYMERIC MULTIFUNCTIONAL ADDITIVES TO IMPROVE THE LOW-TEMPERATURE PROPERTIES OF DISTILLATE FUELS

[75] Inventors: David J. Baillargeon, Cherry Hill; Angeline B. Cardis, Florence; Dale B. Heck, West Deptford, all of N.J.; Susan W. Johnson, Centreville, Va.

[73] Assignee: Mobil Oil Corporation, Fairfax, Va.

[21] Appl. No.: 946,220

[22] Filed: Sep. 17, 1992

[51] Int. Cl.[5] ..... C10L 1/22

[52] U.S. Cl. ..... 44/386; 44/391; 44/392; 525/302; 525/304; 525/305

[58] Field of Search ..... 44/386, 391, 392; 525/302, 304, 305

[56] References Cited

U.S. PATENT DOCUMENTS

| | | | |
|---|---|---|---|
| 5,000,758 | 3/1991 | Baillargeon et al. | 44/399 |
| 5,002,589 | 3/1991 | Baillargeon et al. | 44/399 |
| 5,039,308 | 8/1991 | Baillargeon et al. | 44/391 |
| 5,039,309 | 8/1991 | Baillargeon et al. | 44/391 |

*Primary Examiner*—Ellen M. McAvoy

*Attorney, Agent, or Firm*—Alexander J. McKillop; Malcolm D. Keen; Howard M. Flournoy

[57] ABSTRACT

Additives which improve the low-temperature properties of distillate fuels are the oligomeric/polymeric reaction products of anhydrides and one or more of the following long-chain diols: aminodiols, diaminodiols, amidodiols, with optional termonomers.

23 Claims, No Drawings

OLIGOMERIC/POLYMERIC MULTIFUNCTIONAL ADDITIVES TO IMPROVE THE LOW-TEMPERATURE PROPERTIES OF DISTILLATE FUELS

CROSS-REFERENCE TO RELATED APPLICATIONS

This application is related to pending application Ser. No. 07/620,799, Mobil docket number 5772, filed Dec. 3, 1990.

BACKGROUND OF THE INVENTION

1. Field of the Invention

This application is directed to oligomeric/polymeric multifunctional additives prepared by reacting a suitable anhydride with (1) an aminodiol, (2) a diaminodiol or (3) an amidodiol, said diols containing at least one long-chain hydrocarbyl group ($C_{12}+$) thereby obtaining additive products highly useful for improving the low-temperature properties of distillate fuels and to fuel compositions containing same.

2. Description of Related Art

Traditionally, the low-temperature properties of distillate fuels have been improved by the addition of kerosene, sometimes in very large amounts (5–70 wt %). The kerosene dilutes the wax in the fuel, i.e., lowers the overall weight fraction of wax, and thereby lowers the cloud point, filterability temperature, and pour point simultaneously. The additives of this invention effectively lower both the cloud point and CFPP (Cold Filter Plugging Point) of distillate fuel without any appreciable dilution of the wax component of the fuel.

Other additives known in the art have been used in lieu of kerosene to improve the low-temperature properties of distillate fuels. Many such additives are polyolefin materials with pendent fatty hydrocarbon groups. These additives are limited in their range of activity; however, most improve fuel properties by lowering the pour point and/or filterability temperature. These same additives have little or no effect on the cloud point of the fuel. The additives of this invention effectively lower distillate fuel cloud point, and thus provide improved low-temperature fuel properties, and offer a unique and useful advantage over known distillate fuel additives. No art is known to applicants which teaches or suggests the additive products and compositions of this invention.

BRIEF SUMMARY OF THE INVENTION

Novel polymeric/oligomeric esters and modified polymeric/oligomeric esters have been prepared in accordance with the invention and have been found to be surprisingly active wax crystal modifier additives for distillate fuels. Distillate fuel compositions containing $\geqq 0.1$ wt% of such additives demonstrate significantly improved low-temperature flow properties, i.e., lower cloud point and lower CFPP filterability temperature.

These additives are oligomeric and/or polymeric ester products containing monomers derived from (1) anhydrides and amide derivatized diols, (2) anhydrides and aminodiols and (3) anhydrides and diaminodiols all of which have linear hydrocarbyl pendant groups attached to the backbone of the oligomeric/polymeric structure. These esters are derived from the polymerization, with removal of water or other such by-product, of a suitable combination of monomers which include (1) one or more long-chain amine-containing diols, e.g., the aminodiol may be the reaction product of an amine and an epoxide; the diamino diol may be the reaction product of a diepoxide and a secondary amine and the amidodiol may be the product of a di(hydroxyalkyl)amine and a fatty acid, (2) one or more anhydrides or acid equivalents, and optionally (3) a reactive material, e.g., isocyanates, diisocyanates, epoxy halides, diepoxides, carbamates, dianhydrides, polyols, etc., which may function as a chain transfer agent, chain terminator, chain propagator, and/or chain cross-linking agent.

Additionally, the oligomeric and/or polymeric ester products, derived as described above, may be further reacted with additional reagents in a second synthetic step so as to derivatize, cap, or otherwise modify reactive end groups or other pendant groups incorporated along the backbone of the original oligomeric/polymeric ester. These additional reagents may include, for example, amines or alcohols which would serve to convert residual acids and anhydrides in the oligomeric/polymeric ester product to alternate carboxyl derivatives such as amides, imides, salts, esters, etc. These examples serve to illustrate, but not limit, the concept of post-reacting the original oligomeric/polymeric ester product to modify its chemical functionality. Any amine or alcohol with a reactive functionality is suitable for use herein.

These oligomeric/polymeric esters are structurally very different from the known categories of polymeric wax crystal modifiers. Known polymeric wax crystal modifiers are generally radical-chain reaction products of olefin monomers, with the resulting polymer having an all-carbon backbone. The materials of this invention are condensation products of epoxides (or diols) and anhydrides (or acid equivalents) to give polymeric structures where ester functions are regularly spaced along the polymer backbone.

These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

The compositions of these additives are unique. Also, the additive concentrates and fuel compositions containing such additives are unique. Similarly, the processes for making these additives, additive concentrates, and fuel compositions are unique.

The primary object of this invention is to improve the low-temperature flow properties of distillate fuels. These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

DESCRIPTION OF THE PREFERRED EMBODIMENTS

The additives of this invention have comb-like structures, where a critical number of linear hydrocarbyl groups are attached to the backbone of an oligomeric/polymeric polyester. These additives are reaction products obtained by combining two, or optionally more, monomers in differing ratios using standard techniques for condensation polymerization. These wax crystal modifiers which are effective in lowering cloud point are generally characterized as alternating co-oligomers/copolymers (or optionally terpolymers, etc.) of the following type:

(—A—B)n;

(—A—A'—B)n;

(—A—B—B')n;

(—A—A—B—B')n; or (—A—B—C—)n where n is equal to or greater than 1, A or A' is one or more anhydrides or diacid equivalents, B or B' is one or more long-chain amine-containing diols and C is said reactive material.

One combination of monomers may include (A) one or more anhydrides, (B) one or more long-chain amine-containing diols and optionally (C) a reactive material, e.g., isocyanate, diisocyanate, alkyl halide, diepoxide, dianhydride, etc., which may function as a chain transfer agent, chain terminator, chain propagator, or chain cross-linking agent. Alternatively, a second combination of monomers, in which the removal of a low molecular weight by-product accompanies the condensation reaction, may include (A) one or more diacid equivalents (anhydride, diacid, diacid chloride, etc.), (B) one or more long-chain amine-containing diols, and optionally (C) the same reactive materials listed above. Comonomer stoichiometry may vary widely with A:B=1:2 to 2:1, or preferably A:B=1:1.5 to 1.5:1, or most preferably A:B=1:1.1 to 1.1:1. Optional termonomers, component C, may substitute for some fraction of A or B in the above stoichiometric ranges.

The pendant linear hydrocarbyl groups are carried by at least one, and optionally by more than one, of the monomers. These critical linear pendant hydrocarbyl groups are generally $C_{12}$ or longer. Hydrocarbyl in accordance with the invention includes alkyl, alkenyl, aryl, alkaryl, aralkyl and optionally may be cyclic or polycyclic.

Additives of this invention may be grouped into categories based on distinct structural and compositional differences, described below. Preparation of selected additives are given in EXAMPLES 1-3. Additive compositions and their respective performance for cloud point and CFPP are given in TABLE 1.

Category A: Aminodiol and Anhydride (TABLE 1)

Successful additives may be AB-type oligomers/-polymers which can be prepared using standard condensation polymerization techniques from an anhydride (A monomer) and one or more specifically constructed long-chain amine containing diols (B monomer).

The diol may be the reaction product of a suitable amine and an epoxide. For example, one class of diols are 1,5-diols which are derived from the reaction of a primary amine with two equivalents of epoxide (Entries 60-64):

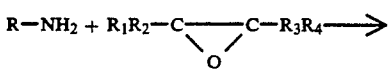

-continued $[HO—C(R_1R_2)—C(R_3R_4)]_2—N—R$

Where $R=C_1-C_{300}$ hydrocarbyl optionally containing O, N, S, P.

$R_1$, $R_2$, $R_3$, $R_4$=H, or $C_1$ to about $C_{300}$ hydrocarbyl, or hydrocarbyl containing O, N, S, P.

For example, a second class of diols are those derived from the reaction of a bis-secondary amine with two equivalents of the epoxide (Entry 65):

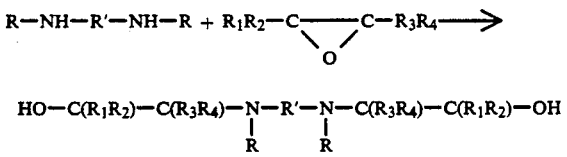

Where $R, R'=C_1-C_{300}$ hydrocarbyl optionally containing O, N, S, P.

$R_1$, $R_2$, $R_3$, $R_4$=H, or hydrocarbyl, or hydrocarbyl containing O, N, S, P.

Stoichiometries of anhydride/diol may vary over the range of 2/1 to ½, and preferably over the range of 1.5/1 to 1/1.5.

A typical synthesis is illustrated by the oligomers/-polymers prepared from the diol derived from a hydrogenated tallow amine capped with two equivalents of 1,2-epoxyoctadecane and from phthalic anhydride (Entry 63, EXAMPLE 1).

Category B: Amidodiols and Anhydride (TABLE 1)

Successful additives may be AB-type oligomers/-polymers which can be prepared using standard condensation polymerization techniques from an anhydride (A monomer) and a reaction product containing mostly an amide-derivatized diol (B monomer). The amidodiol is uniquely different from the other diols discussed above.

The amidodiol is, for example, the reaction product of diethanolamine and one equivalent of a fatty acid derivative. Such a reaction product is a mixture of mostly amide-containing diols and some ester-containing aminoalcohols. The term "amidodiol" as used herein encompasses both structure types. Any fatty acid derivative may be used in these compositions. For example, a typical wax crystal modifier may be prepared from the reaction of diethanolamine and a mostly $C_{18}$ fatty acid, followed by reaction with phthalic anhydride (Entry 66, Example 2).

Category C: Diaminodiol and Anhydride (TABLE 1)

Successful additives may be AB-type oligomers/-polymers which can be prepared using standard condensation polymerization techniques from an anhydride (A monomer) and one or more specifically constructed diaminodiols (B monomer).

The diaminodiol may be the reaction product of a diepoxide and two equivalents of a secondary amine. For example, one class of diaminodiols are those derived from the reaction of diglycidyl ethers with suitable amines (Entries 67-70):

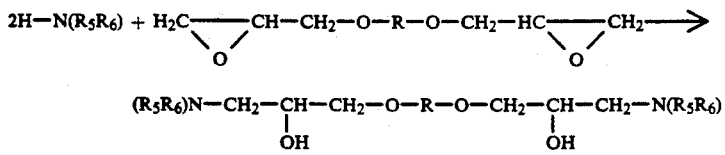

Where $R = C_1$–$C_{300}$ hydrocarbyl optionally containing O, N, S, P, B, Si.

$R_5 = C_8$–$C_{50}C_1$–$C_{30}$ linear hydrocarbyl group $R_6 = R_5$, or $C_1$–$C_{300}$ hydrocarbyl optionally containing O, N, S, P.

When tested alone as wax crystal modifiers in diesel fuel, these diaminodiols increased the fuel's cloud point and thus have adverse effects on fuel properties. When combined with a suitable anhydride to give oligomers/polymers, significantly improved additive activity was discovered (see Entries 71–74). Both cloud point and filterability properties were dramatically improved by these diaminodiol/anhydride compositions.

A typical synthesis is illustrated by the oligomers/polymers prepared from a diglycidyl ether-derived diaminodiol and from phthalic anhydride (Entry 72, in EXAMPLE 3).

The reactions can be carried out under widely varying conditions which are not believed to be critical. The reaction temperatures can vary from about 100° to 225° C., preferably 120° to 180° C., under ambient or autogenous pressure. However, slightly higher pressures may be used if desired. The temperatures chosen will depend upon for the most part on the particular reactants and on whether or not a solvent is used. A solvent need not be used. Solvents, if used, will typically be hydrocarbon solvents such as xylene, but any non-polar, unreactive solvent can be used including benzene and toluene and/or mixtures thereof.

Molar ratios, less than molar ratios or more than molar ratios of the reactants can be used.

The times for the reactions are also not believed to be critical. The process is generally carried out in from about one to twenty-four hours or more.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% of the total weight of the composition.

These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterizes the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specifications D396-48T. Specifications for diesel fuels are defined in A.S.T.M. Specification D975-48T. Typical jet fuels are defined in Military Specification MIL-F-5624B.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% of the total weight of the composition.

The following examples are illustrative only and are not intended to limit the scope of the invention.

EXAMPLE 1

Preparation of Additive Entry 63

Hydrogenated tallow amine (27.5 g, 0.10 mol; e.g., Armeen HT from Akzo Chemie) and 1,2-epoxyoctadecane (57.0 g, 0.20 mol; e.g., Vikolox 18 from Viking Chemical) were combined and heated at 160° C. for 26 hours. Phthalic anhydride (14.8 g, 0.10 mol; e.g., from Aldrich Chemical Co.) and xylene (60 cc) were added, and the mixture was heated at 190° C./18 hours with azeotropic removal of water. Volatiles were then removed from the reaction medium at 190° C., and the reaction mixture was hot filtered through Celite to give 87.7 g of the final product.

EXAMPLE 2

Preparation of Additive Entry 66

Diethanolamine (21.0 g, 0.20 mol; e.g., from Aldrich Chemical Co.), stearic acid (56.2 g, 0.20 mol; e.g., Industrene 9018 from Humko Chemical Co.), and xylene (60 cc) were combined and heated at 170° C./18 hours and 220° C./5 hours with azeotropic removal of water. Phthalic anhydride (29.6 g, 0.20 mol; e.g., from Aldrich Chemical Co.) was added, and the mixture was heated at 170° C./18 hours and 220° C./5 hours with a zeotropic removal of water. Volatiles were then removed from the reaction medium at 190° C., and the reaction mixture was hot filtered through Celite to give 78.3 g of the final product.

EXAMPLE 3

Preparation of Additive Entry 72

Di(hydrogenated tallow) amine (50.0 g, 0.10 mol; e.g., Armeen 2HT from Akzo Chemie) and 1,4-butanediol diglycidyl ether (18.0 g, 0.0625 mol; e.g., Araldite RD-2 from Ciba-Geigy Corp.) were combined and heated at 140°-150° C./22 hours. Phthalic anhydride (8.15 g, 0.055 mol; e.g., from Aldrich Chemical Co.) and xylene (60 cc) were added, and the mixture was heated at 180° C./22 hours with azeotropic removal of water. Volatiles were then removed from the reaction medium at 180° C., and the reaction mixture was hot filtered through Celite to give 63.7 g of the final product.

TEST PROCEDURES

The cloud point of the additized distillate fuel was determined using an automatic cloud point test based on the commercially available Herzog cloud point tester; test cooling rate is approximately 1° C./minute. Results of this test protocol correlate well with ASTM D2500 methods. The test designation (below) is "HERZOG".

The low-temperature filterability was determined using the Cold Filter Plugging Point (CFPP) test. This test procedure is described in "Journal of the Institute of Petroleum", Volume 52, Number 510, June 1966, pp. 173-185.

Test results are recorded in Table 1.

The products of this invention represent a significant new generation of wax crystal modifier additives which are dramatically more effective than may previously known additives. They represent a viable alternative to the use of kerosene in improving diesel fuel low-temperature performance.

TABLE 1

CONDENSATION POLYESTERS: COMPOSITIONS AND PERFORMANCE IN DIESEL FUEL. CATEGORIES A, B, C (See below)

| ENTRY | AMINODIOL, AMIDO-DIOL, or, DIAMINODIOL | ANHYDRIDE | MOLE RATIO | PERFORMANCE IMPROVEMENT (F): CLOUD POINT (HERZOG) | CFPP |
|---|---|---|---|---|---|
| | CATEGORY A: AMINODIOLS FUEL A; 1000 PPM ADDITIVE | | | | |
| 60 | ETHOMEEN 18/12 | PHTHALIC ANHY | 1/1 | 4.9 | 4 |
| 62 | OCTYLAMINE/VIKOLOX 18 | PHTHALIC ANHY | 1/2/1 | 3.6 | 4 |
| 63 | ARMEEN HT/VIKOLOX 18 | PHTHALIC ANHY | 1/2/1 | 4.6 | 5 |
| 64 | ANILINE/VIKOLOX 18 | PHTHALIC ANHY | 1/2/1 | 4.5 | 0 |
| 65 | PIPERAZINE/VIKOLOX 18 | PHTHALIC ANHY | 1/2/1 | 2.5 | −2 |
| | CATEGORY B: AMIDO-DIOLS FULE A; 1000 ppm ADDITIVE | | | | |
| 66 | DIETHANOLAMINE/ INDUSTRENE 9018 | PHTHALIC ANHY | 1/1/1 | 4.7 | −2 |
| | CATEGORY C: DIAMINODIOLS FULE A; 1000 ppm ADDITIVE | | | | |
| 67 | ARMEEN 2HT/AZEPOXY N | | 2/1.25 | −2.5 | 2 |
| 68 | ARMEEN 2HT/ARALDITE RD-2 | | 2/1.25 | −3.4 | 4 |
| 69 | ARMEEN 2HT/DER 736 | | 2/1.25 | −3.2 | 2 |
| 70 | ARMEEN 2HT/DER 732 | | 2/1.25 | −3 | 4 |
| 71 | ARMEEN 2HT/AZEPOXY N | PHTHALIC ANHY | 2/1.25/1.1 | 4.9 | 7 |
| 72 | ARMEEN 2HT/ARALDITE RD-2 | PHTHALIC ANHY | 2/1.25/1.1 | 6.1 | 6 |
| 73 | ARMEEN 2HT/DER 736 | PHTHALIC ANHY | 2/1.25/1.1 | 3.1 | 7 |
| 74 | ARMEEN 2HT/DER 732 | PHTHALIC ANHY | 2/1.25/1.1 | 2.2 | 7 |

PREPARATION OF ADDITIVE CONCENTRATE

A concentrate solution of 100 ml total volume was prepared by dissolving 10 g of additive in mixed xylenes solvent. Any isoluble particulates in the additive concentrate were removed by filtration before use.

TEST FUELS

The following test fuel was used for the screening of additive product activity:

| FUEL A: | | |
|---|---|---|
| API Gravity | 34.1 | |
| Cloud Point (°F.) | 23.4 | |
| CFPP (°F.) | 16 | |
| Pour Point (°F.) | 0 | |
| Distillation (°F.; D 86) | IBP | 319 |
| | 10% | 414 |
| | 50% | 514 |
| | 90% | 628 |
| | FBP | 689 |

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

| APPENDIX 1. GLOSSARY | |
|---|---|
| Araldite RD-2: | 1,4-butanediol diglycidyl ether |
| Armeen HT: | hydrogenated tallow amine |
| Armeen 2HT: | di(hydrogenated tallow) amine |
| Azepoxy N: | neopentanediol diglycidyl ether; 2,2-dimethyl-1,3-propanediol diglycidyl ether |
| CFPP: | cold filter plugging point |
| DER 732: | Dow Epoxy Resin 732; polypropylene glycol diglycidyl ether, average MW = 630 |
| DER 736: | Dow Epoxy Resin 736; polypropylene glucol diglycidyl ether, average MW = 380 |
| Ethomeen 18/12: | octadecyl amine capped with 2 ethylene oxides |
| Herzog: | cloud point test; Herzog method |
| Vikolox "N": | Linear 1,2-epoxyalkane, where |

-continued

| APPENDIX 1. GLOSSARY |
| --- |
| N = the carbon number of the alkyl chain; N = 12, 14, 16, 18, 20, 20–24, 24–28, 30+. |

What is claimed is:

1. A multifunctional low-temperature-modifying distillate fuel additive consisting of a polymeric and/or oligomeric ester additive product of reaction prepared by polymerizing or oligomerizing a suitable combination of monomers selected from the group consisting of (1) one or more aminodiols, diaminodiols or amidodiols, said diols containing at least one or more long-chain hydrocarbyl groups and (2) one or more anhydrides or diacid equivalents, and (3) optionally a suitable reactive material selected from the group consisting of isocyanates, diisocyanates, epoxy halides, carbamates, diepoxides, dianhydrides or polyols, in varying molar ratios under suitable conditions of time, temperature and pressure wherein the molar ratios of reactants vary from equimolar to more than molar to less than molar, at temperatures varying from about 50° to about 250° C. and with pressures varying from atmospheric to slightly higher for times varying from about an hour to 48 hours thereby producing the desired ester additive products said products containing polymeric structures having ester functions and long-chain hydrocarbyl groups independently and regularly spaced along the polymer backbone and wherein hydrocarbyl is selected from the group consisting of alkyl, alkenyl, aryl, alkaryl, aralkyl, which may be cyclic or polycyclic and wherein said ester additive product is (4) optionally post reacted with suitable reactive amines, alcohols or a mixture of such amines and alcohols.

2. The ester additive product of reaction of claim 1 wherein said additive product is prepared from monomers selected from the group consisting of (1) anhydrides and amine-containing diols, (2) anhydrides and diaminodiols, (3) anhydrides and amidodiols and/or are (4) post reacted oligomeric/polymeric esters of (1), (2) or (3).

3. The ester additive products of reaction of claim 2 wherein said products of reaction are prepared from monomer selected from the group consisting of 1,2-epoxyoctadecane, 1,4-butanediol diglycidyl ether, polypropylene glycol diglycidyl ether, 2,2-dimethyl-1,3-propanediol diglycidyl ether, octadecyl amine/ethylene oxide, octylamine, hydrogenated tallow amine, di(hydrogenated tallow) amine, aniline, piperazine and phthalic anhydride.

4. The additive product of claim 1 wherein at least one of said monomers and optionally more than one, has a pendant hydrocarbyl group of at least $C_{12}$ or longer.

5. The additive product of claim 1 wherein the monomers are phthalic anhydride and an amine containing diol derived from 1,2-epoxyoctadecane and hydrogenated tallow amine.

6. The additive product of claim 1 wherein the monomers are phthalic anhydride and an amidodiol derived from stearic acid and diethanolamine.

7. The additive product of claim 1 wherein the monomers are phthalic anhydride and a diaminodiol derived from 1,4-butanediol diglycidyl ether and di(hydrogenated tallow) amine.

8. A process of preparing a multifunctional low-temperature modifying distillate fuel polymeric and/or oligomeric ester product of reaction comprising polymerizing or oligomerizing a suitable combination of monomers selected from the group consisting of (1) one or more aminodiols, diaminodiols, or amidodiols, said diols containing at least one or more long-chain hydrocarbyl groups, and (2) one or more aromatic anhydrides or diacid equivalents or mixtures of (1) and (2), and (3) optionally a suitable reactive material selected from the group consisting of isocyanates, diisocyanates, epoxy halides, carbamates, diepoxides, dianhydrides or polyols, in varying molar ratios under suitable conditions of time, temperature and pressure and wherein the molar ratios of reactants varies from equimolar to more than molar to less than molar, at temperatures varying from about 50° to about 250° C. and with pressures varying from atmospheric to slightly higher for times varying from about an hour to 48 hours or more thereby producing the desired ester additive product said product containing polymeric structures having ester functions having long-chain hydrocarbyl groups independently and regularly spaced along the polymer backbone and wherein hydrocarbyl is selected from the group consisting of alkyl, alkenyl, aryl, aralkyl, alkaryl, which may be cyclic or polycyclic and wherein said ester additive product of reaction is (4) optionally post reacted with a suitable reagent selected from suitable amines and alcohols or mixtures of such amines and alcohols.

9. The process of claim 8 wherein at least one of said monomers and optionally more than one, has a pendant hydrocarbyl group of at least $C_{12}$ or longer.

10. The process of claim 8 wherein the monomers are phthalic anhydride and an amine-containing diol derived from 1,2-epoxyoctadecane and hydrogenated tallow amine.

11. The process of claim 8 wherein the monomers are phthalic anhydride and an amidodiol derived from stearic acid and diethanolamine.

12. The process of claim 8 wherein the monomers phthalic anhydride and a diaminodiol derived from 1,4-butanediol diglycidyl ether and di(hydrogenated tallow) amine.

13. A fuel additive concentrate comprising a suitable major amount of a liquid hydrocarbon solvent having dissolved therein a minor effective amount of a low-temperature modifying fuel additive product of reaction as claimed in claim 1.

14. The fuel additive concentrate of claim 13 having a total volume of about 100 ml, and having about 10 g of said additive product of reaction dissolved therein.

15. The fuel additive concentrate of claim 13 wherein said solvent is selected from the group consisting of xylene, mixed xylenes and toluene.

16. A liquid hydrocarbyl fuel composition comprising a major amount of said fuel and a minor amount of a multifunctional low-temperature modifying distillate fuel polymeric and/or oligomeric ester additive product of reaction prepared by polymerizing or oligomerizing a suitable combination of monomers selected from the group consisting of (1) one or more aminodiols, diaminodiols or aminodiols, said diols containing at least one or more long-chain hydrocarbyl groups (2) one or more anhydrides or diacid equivalents, and (3) a suitable reactive material selected from the group consisting of isocyanates, diisocyanates, epoxy halides, carbamates, diepoxides, dianhydrides or polyols, in varying molar ratios under suitable conditions of time, temperature and pressure wherein the molar ratios of reactants vary from equimolar to more than molar to less than molar, at temperatures varying from about 50° to about 250° C. and with pressures varying from atmospheric to slightly higher for times varying from about an hour to 48 hours thereby producing the desired ester additive product said product containing polymeric structures having ester functions and long-chain hydrocarbyl group independently and regularly spaced along the polymer backbone and wherein hydrocarbyl is selected from the group consisting of alkyl, alkenyl, aryl, alkaryl, aralkyl and my be cyclic or polycyclic and wherein said ester additive product of reaction is (4) post reacted with a suitable reagent selected from suitable amines and alcohols or a mixture of such amines and alcohols.

17. The fuel composition of claim 16 wherein the additive product of reaction is prepared from monomers selected from the group consisting of (1) anhydrides and amine-containing diols as comonomers, (2) anhydrides and diaminodiols as comonomers, (3) anhydrides and amidodiols as comonomers or are (4) post reacted oligomeric or polymeric esters of (1), (2), or (3).

18. The fuel composition of claim 17 wherein the additive products of reaction described therein are prepared from monomers selected from the group consisting of 1,2-epoxyoctadecane, 1,4-butanediol diglycidyl ether, polypropylene glycol diglycidyl ether, 2,2-dimethyl-1,3-propanediol diglycidyl ether, octadecyl amine/ethylene oxide, octylamine, hydrogenated tallow amine, di(hydrogenated tallow) amine, aniline, piperazine and phthalic anhydride.

19. The fuel composition of claim 16 wherein at least one of said monomers and optionally more than one, has a pendant hydrocarbyl group of at least $C_{12}$ or longer.

20. The fuel composition of claim 16 wherein the monomers are phthalic anhydride and an amine-containing diol derived from 1,2-epoxyoctadecane and hydrogenated tallow amine.

21. The fuel composition of claim 16 wherein the monomers are phthalic anhydride and an amidodiol derived from stearic acid and diethanolamine.

22. The fuel composition of claim 16 wherein the monomers are phthalic anhydride and a diaminodiol derived from 1,4-butanediol diglycidyl ether and di(hydrogenated tallow) amine.

23. The fuel composition of claim 16 comprising from about 0.001 to about 10% by weight based on the total weight of the composition of the ester additive product of reaction.

* * * * *